US012520928B2

(12) United States Patent
Nerio

(10) Patent No.: US 12,520,928 B2
(45) Date of Patent: Jan. 13, 2026

(54) APPARATUS, SYSTEMS, AND METHODS OF A MULTI-USE COSMETIC PEN WITH BLOTTING PAPER DISPENSER

(71) Applicant: Connie Michele Nerio, New York, NY (US)

(72) Inventor: Connie Michele Nerio, New York, NY (US)

(73) Assignee: Connie Michele Nerio, New York, NY (US)

( * ) Notice: Subject to any disclaimer, the term of this patent is extended or adjusted under 35 U.S.C. 154(b) by 0 days.

(21) Appl. No.: 18/586,604

(22) Filed: Feb. 26, 2024

(65) Prior Publication Data

US 2024/0285058 A1 Aug. 29, 2024

Related U.S. Application Data

(60) Provisional application No. 63/448,347, filed on Feb. 27, 2023.

(51) Int. Cl.

| | |
|---|---|
| ***A45D 40/18*** | (2006.01) |
| ***A45D 34/04*** | (2006.01) |
| ***A45D 34/06*** | (2006.01) |
| ***A45D 40/22*** | (2006.01) |
| ***A45D 40/26*** | (2006.01) |
| *A45D 40/00* | (2006.01) |

(52) U.S. Cl.

CPC ..... *A45D 40/18* (2013.01); *A45D 34/04* (2013.01); *A45D 34/06* (2013.01); *A45D 40/22* (2013.01); *A45D 40/26* (2013.01); *A45D 2040/0018* (2013.01)

(58) Field of Classification Search

CPC ..... A45D 40/18; A45D 40/24
USPC ..... 401/17, 19, 195
See application file for complete search history.

(56) References Cited

U.S. PATENT DOCUMENTS

| | | | | | |
|---|---|---|---|---|---|
| 6,135,661 | A * | 10/2000 | Houser | B43K 29/12 | 401/52 |
| 8,444,338 | B2 * | 5/2013 | Kurek | A45D 34/06 | 401/89 |
| 9,630,765 | B1 * | 4/2017 | Nelson | A45D 40/18 | |
| 10,973,303 | B2 * | 4/2021 | Esposito | A45D 40/06 | |
| 2005/0150993 | A1 * | 7/2005 | Flis | B43K 29/12 | 242/588 |
| 2022/0167726 | A1 * | 6/2022 | Michael | A45D 40/06 | |

* cited by examiner

*Primary Examiner* — Jennifer C Chiang
(74) *Attorney, Agent, or Firm* — Gearhart Law LLC

(57) ABSTRACT

A cosmetic applicator may include a housing having a first end located opposite a second end, wherein the first end of the housing retaining a substance. The housing may have a hingedly pivotable door configured to be oriented in a closed position to overlay a cartridge retained in the chamber. The cartridge is configured to retain a sheet of material. The sheet of material is configured to be dispensed from the cartridge. A first rotation element may be configured to extend a substance from an end of the housing. A second rotation element may be configured dispense at least a portion of the sheet of material from the housing. The housing may have a blade configured to cut at least a portion of the sheet of material when the sheet of material is dispensed from the chamber of the housing.

4 Claims, 6 Drawing Sheets

APPARATUS, SYSTEMS, AND METHODS OF A MULTI-USE COSMETIC PEN WITH BLOTTING PAPER DISPENSER

FIELD OF THE EMBODIMENTS

The field of the invention and its embodiments relates to cosmetic applicator having a first end configured to retain a substance for application to a user and a second chamber configured to retain a sheet of material configured to be dispensed by a user.

BACKGROUND OF THE EMBODIMENTS

Current cosmetic applicator pens are known to have a multi-use blending brush and/or sponge with a chamber retaining a substance such as lipstick, eyeshadow, and/or mascara. Other cosmetic applicators in today's market are known to have two chambers configured to retain two differing cosmetic substances. In a first example, the cosmetic applicator has a mascara primer and a mascara. In a second example, the cosmetic applicator has a lip gloss with a high gloss finish and a lip gloss with a matte finish. Further, it is known for a makeup remover tissue, facial tissue, oil remover pad, blotting paper, and/or wipe to be packaged separately from a cosmetic applicator. It would be more desirable to a user to be able to quickly access a facial tissue during makeup application without having to acquire separate packaging from a cosmetic.

REVIEW OF RELATED ART

U.S. Pat. No. 8,282,776—This reference discloses a wiping product containing an additive composition that enhances the cleaning properties of the product. The additive composition, for instance, comprises an aqueous dispersion containing an alpha-olefin polymer, an ethylene-carboxylic acid copolymer, or mixtures thereof. The alpha-olefin polymer may comprise an interpolymer of ethylene and octene, while the ethylene-carboxylic acid copolymer may comprise ethylene-acrylic acid copolymer. The additive composition may also contain a dispersing agent, such as a fatty acid.

U.S. Pat. No. 8,790,030—This reference describes compositions that can be used to improve the skin's visual appearance. In one particular aspect, the compositions concern formulations that can be used to treat skin in and around the lips (e.g., lipsticks, lip glosses, lip balms, etc.). US20170013941—This reference teaches a "Finishing Pen", in which a brow pencil, eye liner pencil, "Push Pop Lip gloss/Lip stick" and mascara are individually purchased. They have threaded "female" bottoms for ease of removal, filling and re-filling while holding them intact and stationary. The cap is removed from the pencil end, and the button is pushed on the retractable track to extend the track with the threaded "male" bottom. The brow pencil is threaded on and the button is pushed back down to retract. The same is done for the eye liner pencil and "Push Pop. Lip gloss/Lip stick". The cap is replaced to keep the product clean. On the other end, the Mascara is threaded into the pen. The "Finishing Pen" is ready. The two pens/embodiments are then pushed together, where the magnets keep them connected as one.

SUMMARY OF THE EMBODIMENTS

In accordance with the principles of the present invention, an apparatus, system, and method of a multi-use cosmetic applicator with a blotting paper dispenser. The pen and/or cosmetic applicator has a housing having a first end and second end. The first end of the cosmetic applicator housing may have a first chamber retaining a first substance and a second chamber retaining a removable a dispenser. The removable dispenser retaining a blotting material. In a preferred embodiment, the cosmetic applicator includes a cosmetic chamber retaining a cosmetic including, but not limited to, a lip balm, a lip gloss, a lipstick, and/or a lip color. The dispenser includes a dispenser chamber retaining a blotting paper material and/or a blotting powder material. The cosmetic applicator may be adapted to apply a surface coating of a cosmetic substance, such as to a user's lips, whereas the dispenser may be adapted to dispense a surface absorbent material to absorb and/or remove oil, moisture, and/or cosmetic substance (e.g., excess cosmetics) from a user's skin and/or lips. In a preferred embodiment, each end may include an end cap, and which also includes improvements that overcome the limitations of prior cosmetic applicators, is now met by a new, useful, and non-obvious invention.

DESCRIPTION OF THE PREFERRED EMBODIMENTS

Figure 1:
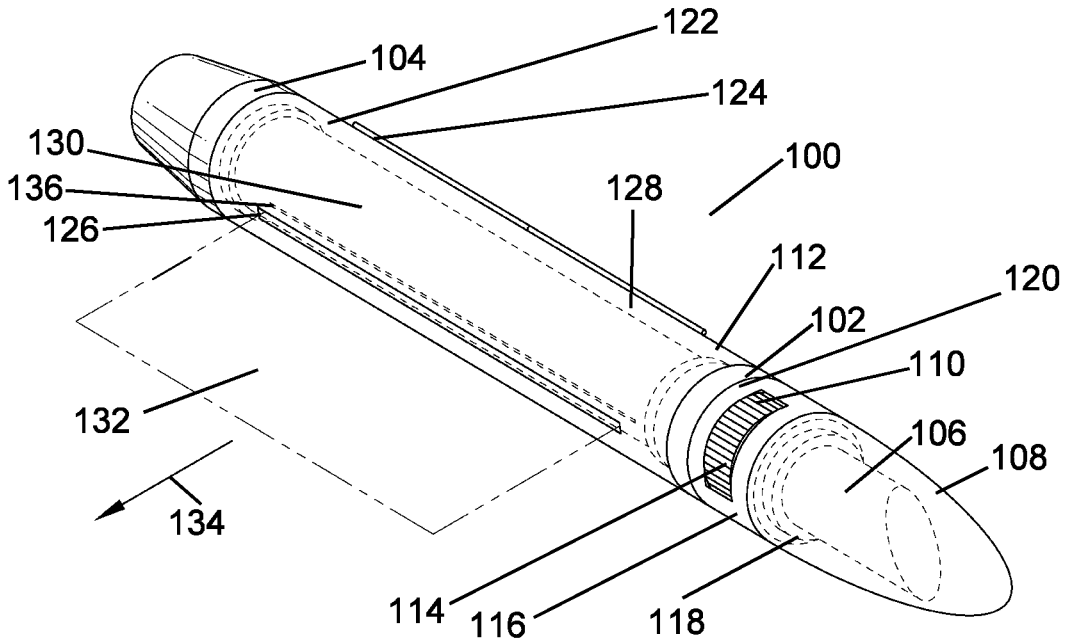
FIG. 1 depicts a perspective view of the cosmetic applicator having a first end in communication with a substance and a hingedly pivotable door overlaying a chamber retaining a removable cartridge configured to dispense a sheet of material, according to at least some embodiments disclosed herein.

The preferred embodiments of the present invention will now be described with reference to the drawings. Identical elements in the various figures may be identified with the same reference numerals. Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As used herein, the singular forms "a," "an," and "the," are intended to include the plural forms as well, unless the context clearly indicates otherwise.

The phrase "and/or," as used herein in the specification and in the claims, should be understood to mean "either or both" of the elements so conjoined, i.e., elements that are conjunctively present in some cases and disjunctively present in other cases. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Figure 2:
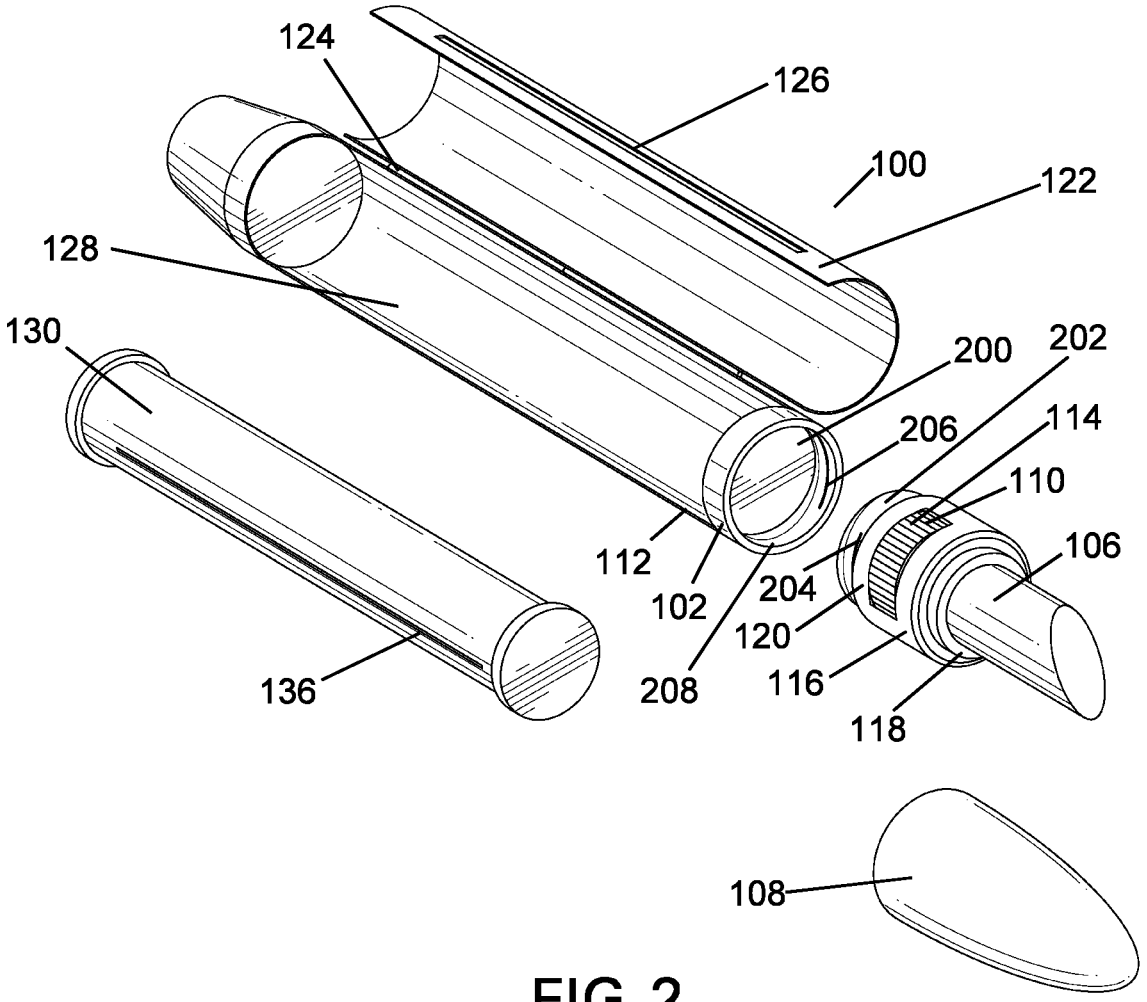
FIG. 2 depicts an exploded view of the cosmetic applicator of FIG. 1 having a first end in communication with a substance and a hingedly pivotable door overlaying a chamber retaining a removable cartridge configured to dispense a sheet of material, according to at least some embodiments disclosed herein.

FIGS. 1 and 2 depicts an illustration of cosmetic applicator 100 having housing 112 with first end 102 located opposite second end 104. First end 102 of housing 112 of cosmetic applicator 100 is in communication with a substance 106. It is within the scope of this invention for communication to include, but not be limited to, directly connected to and/or indirectly connected such as with an adapter being an attachment structure retaining a substance. It is within the scope of this invention for a substance to include, but not be limited to, any cosmetic such as lipstick, lip balm, eyeliner, eyeshadow, blush, concealer, mascara, and/or a highlighter. Substance 106 is covered with removable cap 108. Removable cap 108 provides a barrier to protect contaminants and/or debris from contacting substance 106. Substance 106 may be in any form including, but not limited to a liquid, a solid, gel, and/or a cream. In an embodiment, substance is capable of being oriented in an extended and/or retracted orientation with a rotation element.

Figure 3:
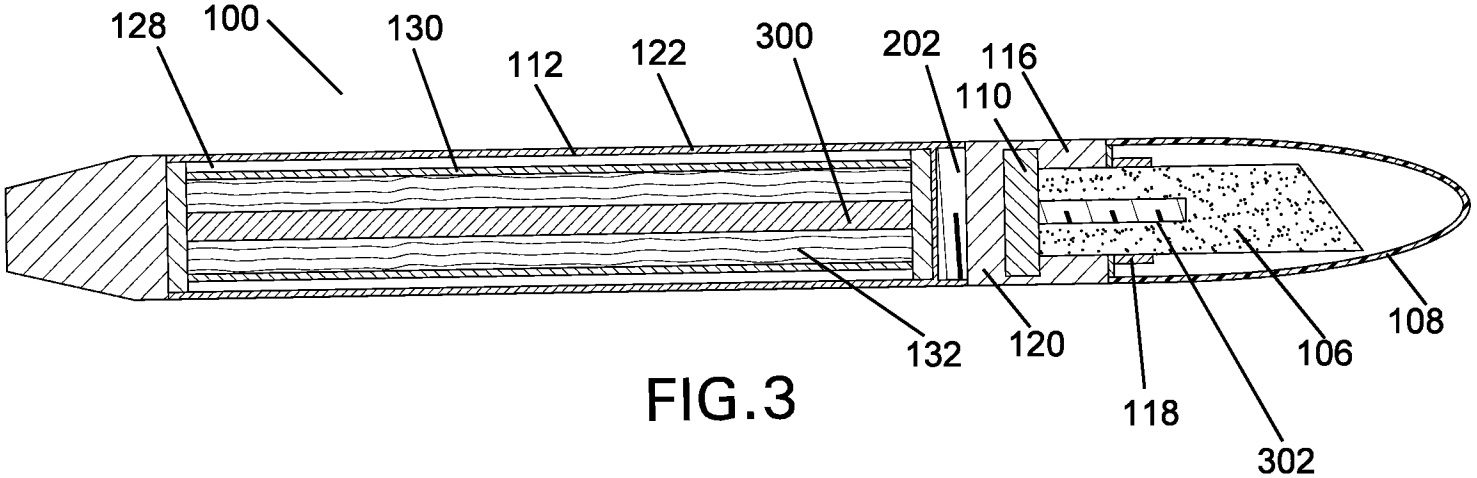
FIG. 3 depicts a side cut-away view of the cosmetic applicator of FIG. 1 having a first end in communication with a substance and a chamber retaining a cartridge configured to dispense a sheet of material, according to at least some embodiments disclosed herein.

Referring now to FIG. 2, first end 102 of cosmetic applicator 100 has first chamber 200. In an embodiment not shown, first chamber 200 may retain a substance. In another embodiment, first chamber 200 may retain at least a portion of attachment structure 116. Referring now to FIGS. 1, 2 and 3, attachment structure 116 has first end 118 located opposite second end 120. First end 118 of attachment structure 116 borders at least a portion of substance 106. At least a portion of substance 106 may protrude from first end 118 of attachment structure 116. Second end 120 of attachment structure 116 is removably connected to first end 102 (FIGS. 1 and 2) of housing 112 of cosmetic applicator 100. In particular, second end 120 of attachment structure 116 has protrusion 202 with first helical threaded portion 204 (FIG. 2) configured to engage second helical threaded portion 206 (FIG. 2) of inner wall surface 208 (FIG. 2) of first chamber 200 (FIG. 2).

Referring again to FIGS. 1 and 2, attachment structure 116 has rotation element 110 having plurality of ridges 114 configured for a user to grip. When rotation element 110 is rotated, substance 106 may be retracted and/or extended depending on the direction of rotation of rotation element 110. For example, lipstick 106 may be extended from a chamber (not shown) of attachment structure 116 to provide more lipstick to a user. Since substance 106 is consumable, it is more desirable for a user to have access to more substance 106 when substance 106 has been depleted. Rotation element 110 allows a user to have access to additional substance 106 when substance 106 is extended from first end 118 of attachment structure 116. Further, when substance 106 is fully extended from first end 118 of attachment structure 116 and substance 106 has been fully used and/or exhausted by a user, attachment structure 116 may be replaced with a subsequent and/or a new attachment structure of the same substance, the same substance having a new color, the same substance having the same color, and/or a new substance 106. For example, replaceable, interchangeable, and/or removable attachment structures 116 may retain a plurality of differing substances such as lipstick, an eyeshadow stick, and/or a blush stick.

Figure 4:
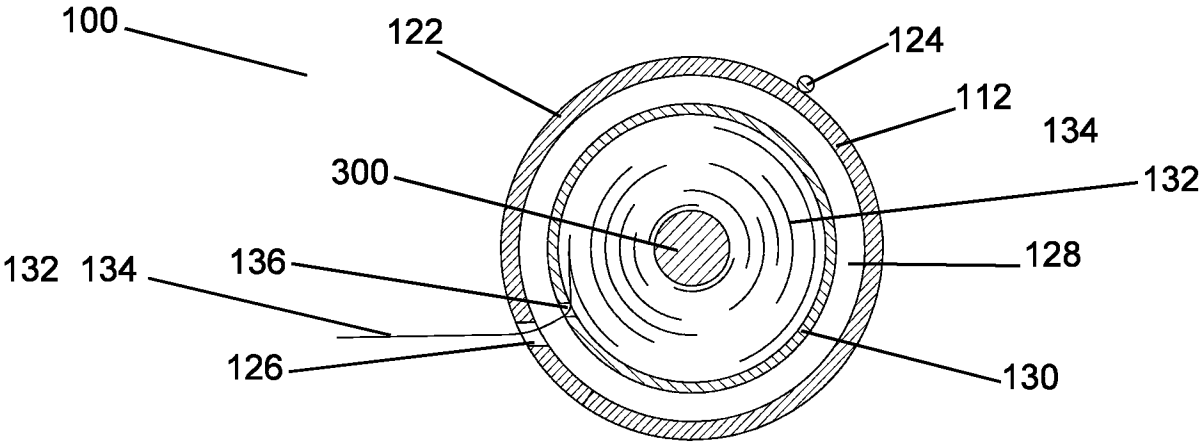
FIG. 4 depicts an end cut-away view of the cosmetic applicator of FIG. 1 having a hingedly pivotable door overlaying a chamber of the housing retaining a cartridge configured to dispense a sheet of material, according to at least some embodiments disclosed herein.

FIGS. 1, 2, and 4 show housing 112 having hingedly pivotable door 122 configured to open and close at hinge 124. Housing 112 has second chamber 128 configured to retain cartridge 130. Cartridge 130 is configured to dispense 134 (FIGS. 1 and 4) sheet of material 132 (FIGS. 1 and 4).

It is within the scope of this invention for sheet of material 132 to be any material including, but not limited to, a wipe, a wet wipe, a tissue, a facial tissue, a makeup remover towel, a pad, an oil wicking pad, a blotting paper, a paper, and/or an oil absorbing material. Sheet of material 132 is configured to be retained within cartridge 130 and dispensed 134 (FIGS. 1 and 4) from opening 136 of cartridge 130. Sheet of material 132 may be stored within cartridge 130 as stacked sheets and/or wrapped around a rod and/or a roll. Cartridge 130 may be refillable and/or replaceable when the sheets of material 132 are depleted. Cartridge 130 is removably inserted into second chamber 128 of housing 112. Hingedly pivotable door 122 is oriented in a closed position. Hingedly pivotable door 122 has opening 126 that substantially aligns with opening 136 of cartridge 130 when hingedly pivotable door 122 is oriented in a closed position. Sheet of material 132 is expelled from cartridge 130 by the force of a user pulling sheet of material 132. Sheet of material 132 is dispensed from cartridge 130 when it passes through both opening 136 of cartridge 130 and opening 126 of hingedly pivotable door 122 of housing 112. It is within the scope of this invention for hingedly pivotable door 122 of housing 112 to be radiused to snuggly retain cartridge 130.

FIGS. 3 and 4 illustrate cosmetic applicator 100 having housing 112 with second chamber 128 retaining removable cartridge 130. Sheet of material 132 is wrapped around rod 300. FIG. 3 best depicts support structure 302 having an end connected to rotation element 110. Substance 106 is connected to at least a portion of support structure 302. Support structure 302 orients substance 106 to rotate when rotation element 110 is rotated by a user.

Figure 5:
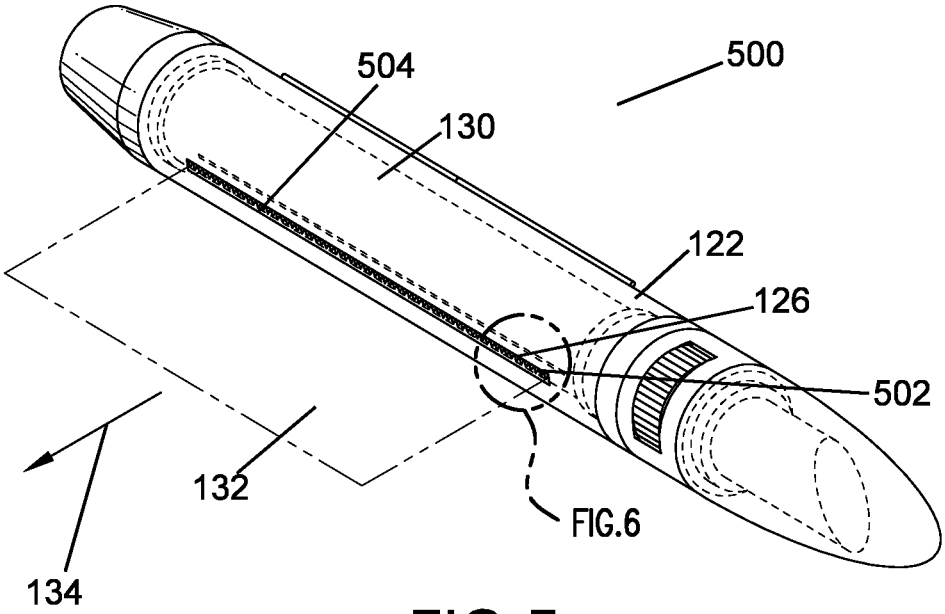
FIG. 5 depicts a perspective view of an alternate embodiment of the cosmetic applicator of FIG. 1 having a chamber with a blade bordering an inner wall surface of an opening of the chamber, according to at least some embodiments disclosed herein.
Figure 6:
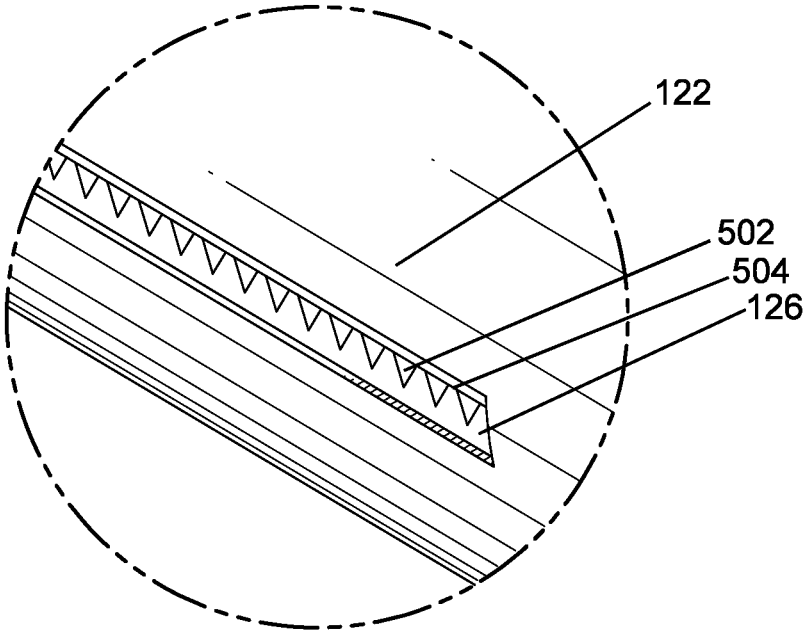
FIG. 6 depicts a sectional view of the blade of FIG. 5 bordering an inner wall surface of an opening of the chamber, according to at least some embodiments disclosed herein.

FIG. 5 depicts an embodiment of cosmetic applicator 500 having hingedly pivotable door 122 with opening 126. FIGS. 5 and 6 illustrate blade 502 bordering at least a portion of inner wall surface 504 of opening 126 hingedly pivotable door 122. Referring now to FIG. 5, blade 502 is configured to cut and/or tear sheet of material 132 when sheet of material 132 is dispensed 134 from cartridge 130. It is within the scope of this invention for a single blade 502 and/or a plurality of blades to be connected to inner wall surface 504 bordering at least a portion of opening 126.

Figure 7:
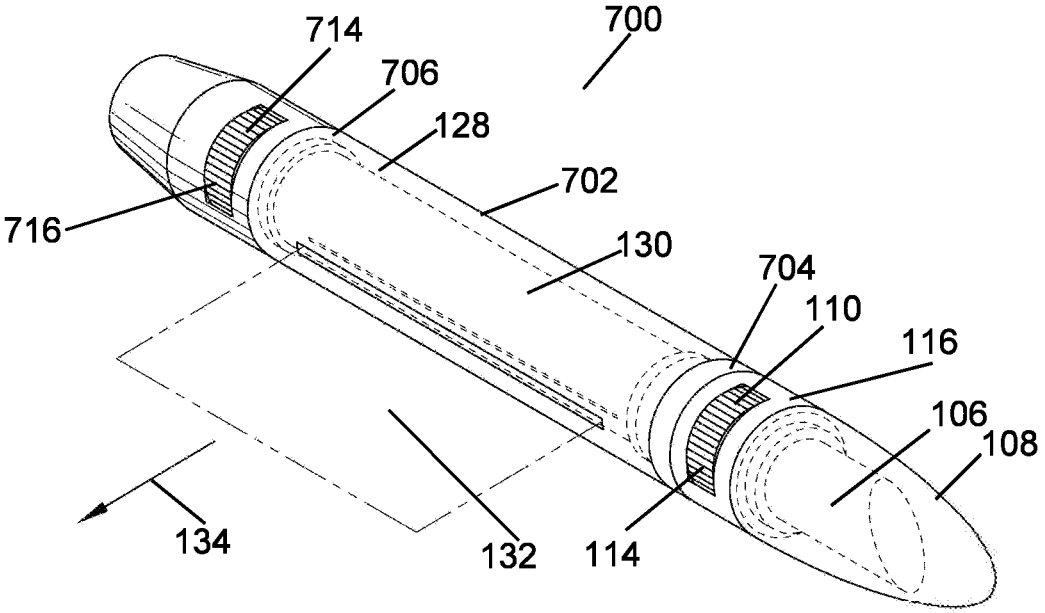
FIG. 7 depicts a perspective view of an embodiment of cosmetic applicator having a housing with a first end in communication with a substance and a chamber retaining a cartridge configured to dispense a sheet of material using a rotation element, according to at least some embodiments disclosed herein.
Figure 8:
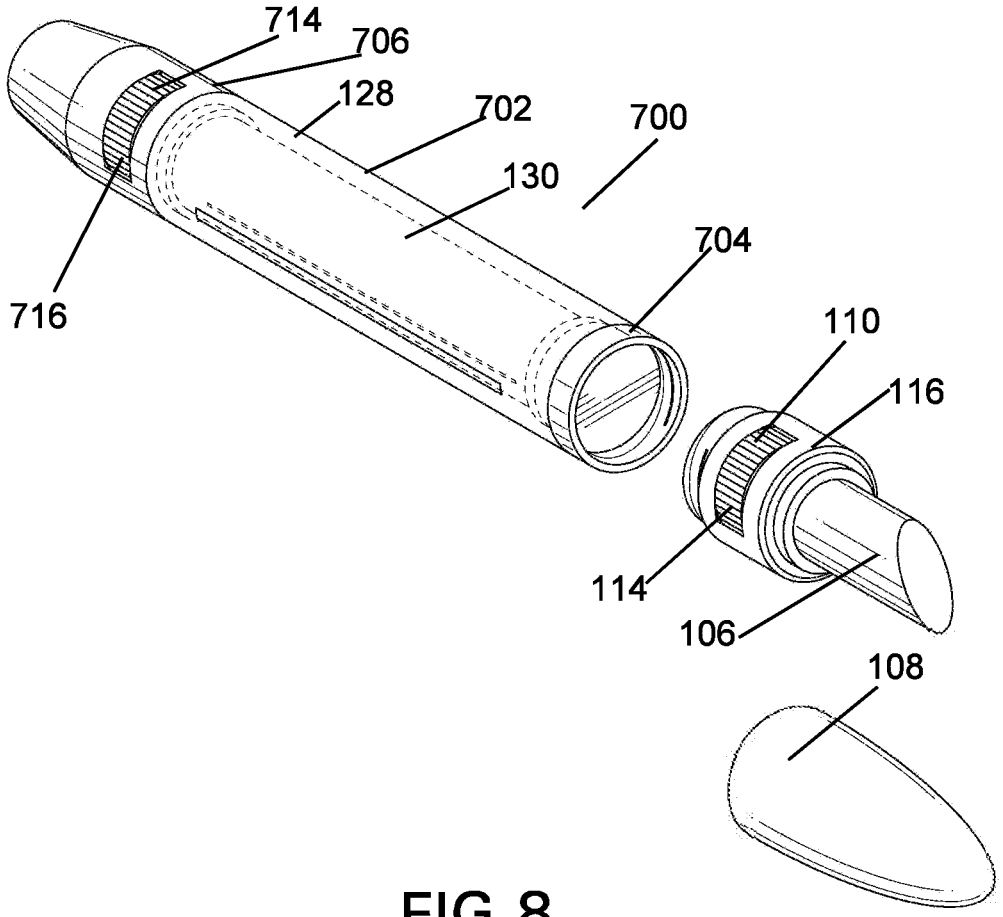
FIG. 8 depicts an exploded view of the cosmetic applicator of FIG. 7 having a housing with a first end in communication with a substance and a chamber retaining a cartridge configured to dispense a sheet of material using a rotation element, according to at least some embodiments disclosed herein.

FIGS. 7-8 depict an embodiment of housing 702 of cosmetic applicator 700 having first end 704 located opposite second end 706. First end 704 of housing 702 of cosmetic applicator 700 is in communication with substance 106. It is within the scope of this invention for a substance to include, but not be limited to, any cosmetic such as lipstick, lip balm, eyeliner, eyeshadow, blush, concealer, mascara, and/or a highlighter. Substance 106 is covered with removable cap 108. Removable cap 108 provides a barrier to protect contaminants and/or debris from contacting substance 106. The substance 106 may be in any form including, but not limited to a liquid, a solid, gel, and/or a cream. Second end 706 of housing 702 has second rotation element 714 having plurality of ridges 716 configured for a user (not shown) to grip when rotating rotation element 714 to unroll at least a portion of sheet of material 132 (FIG. 7) from a rod (not shown) retained within second chamber 128. At least a portion of sheet of material 132 (FIG. 7) is dispensed 134 (FIG. 7) from second chamber 128.

FIGS. 7-8 show attachment structure 116 having rotation element 110 having plurality of ridges 114 configured for a user to grip. When rotation element 110 is rotated, substance 106 may be retracted and/or extended depending on the direction of rotation of rotation element 110. For example, lipstick 106 may be extended from a chamber (not shown) of attachment structure 116 to provide more lipstick to a user. Since substance 106 is consumable, it is more desirable for a user to have access to more substance 106.

Figure 9:
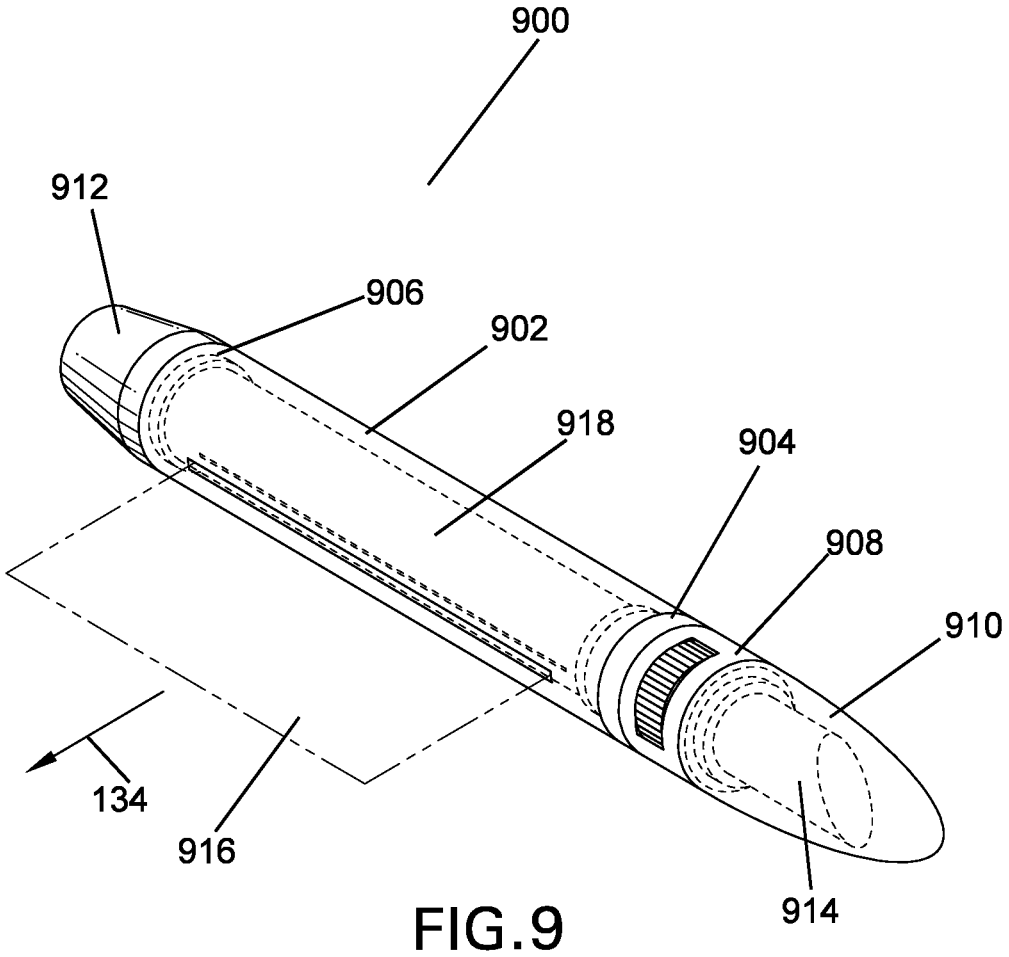
FIG. 9 depicts a perspective view of an embodiment of cosmetic applicator having a housing with a first end in communication with a substance and configured to be covered with a first cap, a chamber retaining a cartridge configured to dispense a sheet of material, an end of the housing having a removable second cap configured to cover an opening adapted to receive the cartridge dispenser, according to at least some embodiments disclosed herein.
Figure 10:
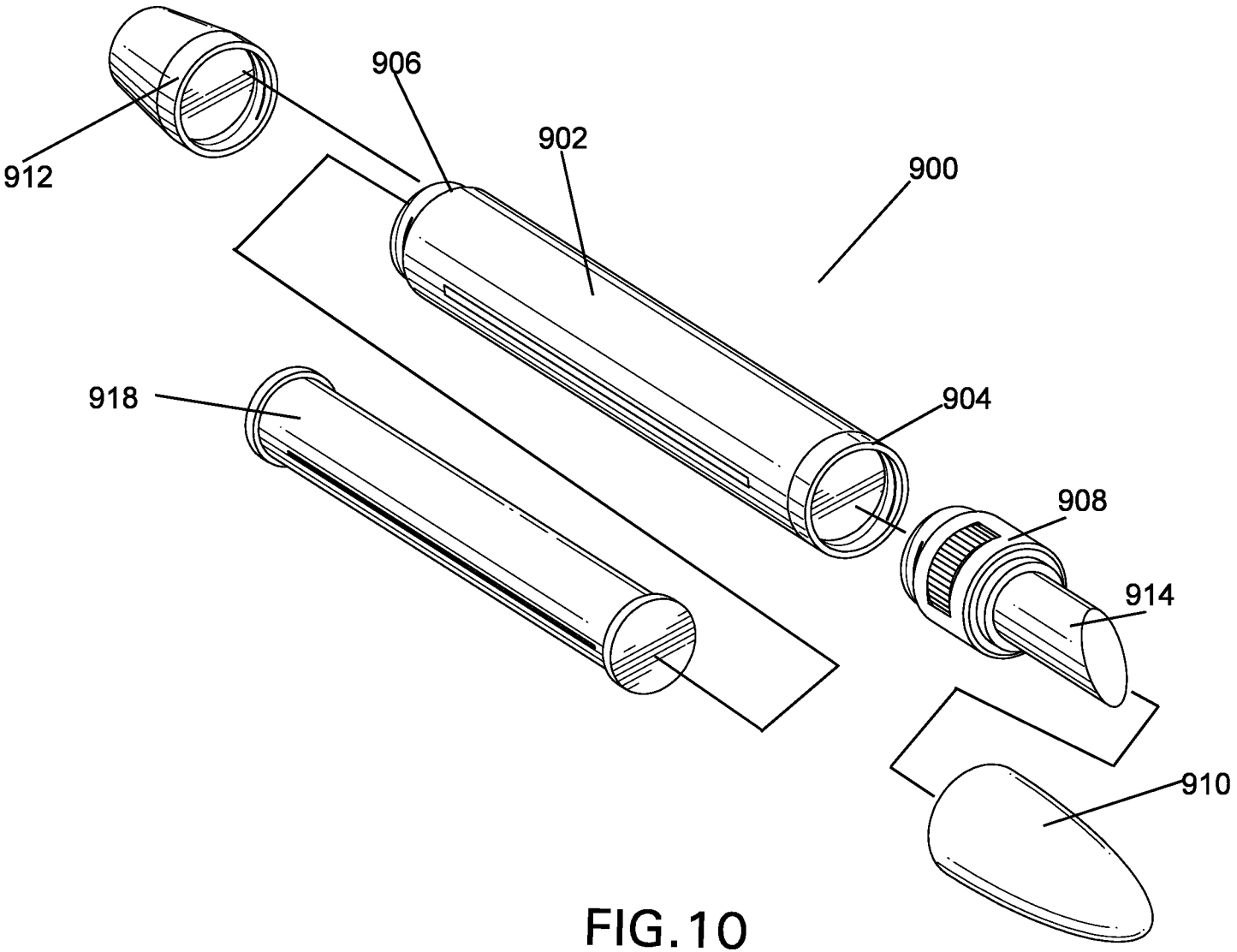
FIG. 10 depicts an exploded view of the cosmetic applicator of FIG. 9 having a housing with a first end in communication with a substance and configured to be covered with a first cap, a chamber retaining a cartridge configured to dispense a sheet of material, an end of the cosmetic applicator having a removable second cap configured to cover an opening adapted to receive the cartridge dispenser, according to at least some embodiments disclosed herein.

FIGS. 9-10 illustrate an embodiment of housing 902 of cosmetic applicator 900 not having a hingedly pivotable door, as shown in the embodiment of FIGS. 1-5, covering the second chamber, but having a removable second cap 912 configured to cover an opening (not shown) of second end 906 of housing 902. It is within the scope of this invention for removable second cap 912 to have a threaded portion to engage with another threaded portion of second end 906 of housing 902. Second end 906 of housing 902 has an opening configured to receive cartridge 918 retaining sheet of material 916 (FIG. 9). In particular, FIGS. 9-10 illustrate cosmetic applicator 900 having housing 902 with first end 904 located opposite second end 906. First end 904 of housing 902 of cosmetic applicator 900 is in communication with substance 914. Attachment structure 908 is connected to first end 904 of housing 902. Attachment structure 908 has an end retaining substance 914. It is within the scope of this invention for substance 914 to include, but not be limited to, any cosmetic such as lipstick, lip balm, eyeliner, eyeshadow, blush, concealer, mascara, and/or a highlighter. Substance 914 is covered with first removable cap 910. First removable cap 910 provides a barrier to protect contaminants and/or debris from contacting substance 914. The substance 914 may be in any form including, but not limited to, a liquid, a solid, gel, and/or a cream.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the description is intended to cover all of the generic and specific features of the invention herein described, and all statements of the scope of the invention that, as a matter of language, might be said to fall therebetween.

It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

Now that the invention has been described.

What is claimed is:

1. A cosmetic applicator comprising a housing comprising:

a first chamber and a second chamber, the first chamber configured to house a substance, and the second chamber configured to house a cartridge, the substance comprising lipstick, lip balm, eyeliner, eyeshadow, blush, concealer, mascara, or a highlighter, and the cartridge comprising a sheet of material; and a rotation element configured to rotate to unroll at least a portion of a sheet of material from a rod retained within the cartridge, wherein the sheet of material is configured to be dispensed from the cartridge.

2. The cosmetic applicator of claim 1, wherein the sheet of material is a wipe, a wet wipe, a tissue, a facial tissue, a makeup remover towel, a pad, an oil wicking pad, a blotting paper, a paper, or an oil absorbing material.

3. The cosmetic applicator of claim 1, wherein the cosmetic applicator further comprises a hingedly connected pivotable door with an opening, that when closed is configured to align with an opening in the housing.

4. The cosmetic applicator of claim 3, wherein the housing further comprises a blade configured to rip and or tear the sheet of material.

* * * * *